US006637449B2

(12) United States Patent
Nagai et al.

(10) Patent No.: US 6,637,449 B2
(45) Date of Patent: Oct. 28, 2003

(54) PRESSURE SENSIBLE VALVE FOR EXHAUST MUFFLER AND METHOD OF ASSEMBLING SAME

(75) Inventors: Tadashi Nagai, Kanagawa (JP); Kai Shiraishi, Kanagawa (JP)

(73) Assignee: Calsonic Kansei Corporation, Tokyo (JP)

( * ) Notice: Subject to any disclaimer, the term of this patent is extended or adjusted under 35 U.S.C. 154(b) by 108 days.

(21) Appl. No.: 09/949,828

(22) Filed: Sep. 12, 2001

(65) Prior Publication Data

US 2002/0029807 A1 Mar. 14, 2002

(30) Foreign Application Priority Data

Sep. 11, 2000 (JP) ..... 2000-275073

(51) Int. Cl.[7] ..... F16K 15/03; F01N 1/08

(52) U.S. Cl. ..... 137/15.18; 137/527.4; 137/527.6; 137/315.16; 251/333; 60/324; 181/226

(58) Field of Search ..... 137/527, 527.4, 137/527.6, 15.18, 315.16, 315.33; 251/87, 303, 333; 60/324; 181/226

(56) References Cited

U.S. PATENT DOCUMENTS 2,494,016 A * 1/1950 Taylor ..... 137/527.6
2,694,358 A * 11/1954 Taylor ..... 137/527.6
2,960,178 A * 11/1960 De Lorean ..... 181/238
3,234,924 A * 2/1966 May ..... 123/323
3,498,322 A * 3/1970 Gilliam ..... 137/527.6
3,870,071 A * 3/1975 Graham et al. ..... 137/527
4,484,659 A * 11/1984 Buchwalder ..... 181/266
4,707,987 A * 11/1987 Atkin ..... 60/324
5,355,673 A * 10/1994 Sterling et al. ..... 137/527
5,614,699 A * 3/1997 Yashiro et al. ..... 181/254
5,709,241 A * 1/1998 Iwata ..... 137/527.6
5,712,454 A * 1/1998 Ozawa et al. ..... 181/226
5,723,827 A * 3/1998 Sasaki et al. ..... 181/237

FOREIGN PATENT DOCUMENTS

JP 10-131738 5/1998

* cited by examiner

*Primary Examiner*—Michael Powell Buiz
*Assistant Examiner*—Ramesh Krishnamurthy
(74) *Attorney, Agent, or Firm*—Foley & Lardner

(57) ABSTRACT

A valve seat structure is secured to an outlet end of a passing pipe installed in an exhaust muffler. The valve seat structure includes a flat seat surface portion which extends around the outlet end of the passing pipe. A valve plate structure is pivotally connected to the valve seat structure. The valve plate structure includes a valve plate portion and a flat sealing portion which forms a peripheral part of the valve plate portion. The valve plate structure has a close position wherein the valve plate portion closes the outlet end of the passing pipe having the flat sealing portion entirely pressed against the flat seat surface of the valve seat structure and an open position wherein the valve plate portion opens the outlet end of the passing pipe having the flat sealing portion separated from the flat seat surface. A biasing structure biases the valve plate structure to assume the close position.

9 Claims, 8 Drawing Sheets

PRESSURE SENSIBLE VALVE FOR EXHAUST MUFFLER AND METHOD OF ASSEMBLING SAME

BACKGROUND OF THE INVENTION

1. Field of the Invention

The present invention relates in general to mufflers for use in an exhaust system of an internal combustion engine of a motor vehicle, and more particularly to the exhaust mufflers of a type which can control the performance thereof in accordance with an operation condition of the engine. More specifically, the present invention is concerned with a pressure sensible valve for use in such controllable exhaust muffler.

2. Description of the Related Art

In order to clarify the task of the present invention, one known pressure sensible valve will be briefly described with reference to FIG. 13 of the accompanying drawings, which is shown in laid-open Japanese Patent Application (Tokkai-Hei) 10-131738.

In FIG. 13, there is shown a controllable exhaust muffler 100 which has the known pressure sensible valve mounted therein. The muffler 100 comprises a casing 101 and two partition walls 101A and 101B which are arranged in the casing 101 to partition the interior of the casing 101 into three chambers A, B and C, as shown. The partition walls 101A and 101B are respectively formed with openings for mounting a passing pipe 102 which extends across the chamber B to connect the chambers A and C. The passing pipe 102 is welded to the partition walls 101A and 100B at the openings. The partition wall 101A is formed around the opening thereof with a tapered depression 104 which is depressed toward the other partition wall 101B. The depression 104 can be closed by a valve plate 107 which is pivotally held by stands 105 mounted on the partition wall 101A. Thus, the tapered depression 104 can serve as a valve seat 103. The valve plate 107 has a tapered periphery 108 that is shaped to mate with the tapered side surface of the depression 104. A pivot shaft 106 extends between the stands 105 to allow the pivoting movement of the valve plate 107 relative to the stands 105. A coil spring 109 is disposed around the pivot shaft 106 to bias the valve plate 107 in a direction to close the depression 104, that is, in a direction to close an outlet opening of the passing pipe 102 which is exposed to the chamber A. The depression 104 has a sealing member 110 disposed on the tapered surface thereof, The sealing member 110 is made of a heat resistant material, such as wire mesh or the like. Usually, due to the biasing force of the coil spring 109, the valve plate 107 is seated in the depression 104 closing the outlet opening of the passing pipe 102, as shown in the drawing. While, when the exhaust pressure in the chamber C exceeds a predetermined value that corresponds to the biasing force of the coil spring 109, the valve plate 107 is lifted from the depression 104 thereby to establish a fluid connection between the chambers A and C. Upon this, the performance of the muffler 100 changes.

However, due to difficulty in assembly, the above-mentioned pressure sensible valve fails to establish an accurate relative positioning between the tapered depression 104 (or valve seat 103) and the valve plate 107. That is, if the relative positioning is not accurately made, exhaust gas leakage tends to occur through the valve, which of course deteriorates the muffling performance of the muffler 100.

SUMMARY OF THE INVENTION

It is therefore an object of the present invention to provide a pressure sensible valve for an exhaust muffler, which is free of the above-mentioned drawback.

According to the present invention, there is provided a pressure sensible valve for use in an exhaust muffler, which can be readily assembled while assuring a positioning of a valve plate structure relative to a valve seat structure.

That is, according to the present invention, a sealed condition of the valve is assuredly made in a closed position of the same even when the valve plate structure makes a displacement by some degree relative to the valve seat structure.

According to a first aspect of the present invention, there is provided a valve for use in an exhaust muffler, which comprises a valve seat structure adapted to be secured to an outlet end of a passing pipe installed in the exhaust muffler, the valve seat structure including a flat seat surface portion which extends around the outlet end of the passing pipe; a valve plate structure pivotally connected to the valve seat structure, the valve plate structure including a valve plate portion and a flat sealing portion which forms a peripheral part of the valve plate portion, the valve plate structure having a close position wherein the valve plate portion closes the outlet end of the passing pipe having the flat sealing portion entirely pressed against the flat seat surface of the valve seat structure and an open position wherein the valve plate portion opens the outlet end of the passing pipe having the flat sealing portion separated from the flat seat surface; and a biasing structure which biases the valve plate structure to assume the close position.

According to a second aspect of the present invention, there is provided a valve for use with a passing pipe installed in an exhaust muffler, which comprises a valve seat structure adapted to be secured to an outlet end of a passing pipe installed in the exhaust mufflers the valve seat structure including a collar portion which is adapted to be disposed on an outlet end of the passing pipe and an annular flat seat surface portion which is defined on the collar portion in a manner to extend around the outlet end of the passing pipe; a valve plate structure including a circular valve plate portion and an annular flat sealing portion which forms a peripheral part of the circular valve plate portion, the valve plate structure having a close position wherein the circular valve plate portion closes a circular opening of the collar portion having the annular flat sealing portion entirely pressed against the annular flat seat surface of the valve seat structure and an open position wherein the circular valve plate portion opens the circular opening of the collar portion having the annular flat sealing portion separated from the annular flat seat surface; a pivot structure through which the valve plate structure is pivotally connected to the valve seat structure; an annular seal member which is fixed to one of the annular flat seat surface and the annular flat sealing portion, so that when the valve plate structure takes the close position, the annular seal member is compressed between the annular flat seat surface and the annular flat sealing portion thereby assuring sealing therebetween; and a biasing structure which biases the valve plate structure to assume the close position.

According to a third aspect of the present invention, there is provided a method of assembling a valve, which comprises the steps of (a) preparing a valve seat structure and a valve plate structure, the valve seat structure including a first pair of side wall portions which are formed with first aligned openings which are elliptic in shape, the valve plate structure including a second pair of side wall portions which are formed with second aligned openings which are circular in shape; (b) putting the second side wall portions between the first side wall portions and keeping the second and first side wall portions in such a manner that the first and second aligned openings are all aligned; (c) inserting a pivot shaft into the aligned first and second openings so that the valve plate structure becomes pivotal relative to the valve seat structure about the pivot shaft; (d) positioning the valve plate structure relative to the valve seat structure by moving the pivot shaft in the first aligned openings; and (e) welding the pivot shaft to the first side wall portions while keeping the positioning between the valve plate structure and the valve seat structure.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

In the following, embodiments of the present invention will be described in detail with reference to the accompanying drawings.

For ease of understanding, various directional terms, such as, right, left, upper, lower, rightward, leftward and the like are used in the following description. However, these terms are to be understood with respect to only drawing or drawing on which the corresponding part or portion is shown.

Figure 12:
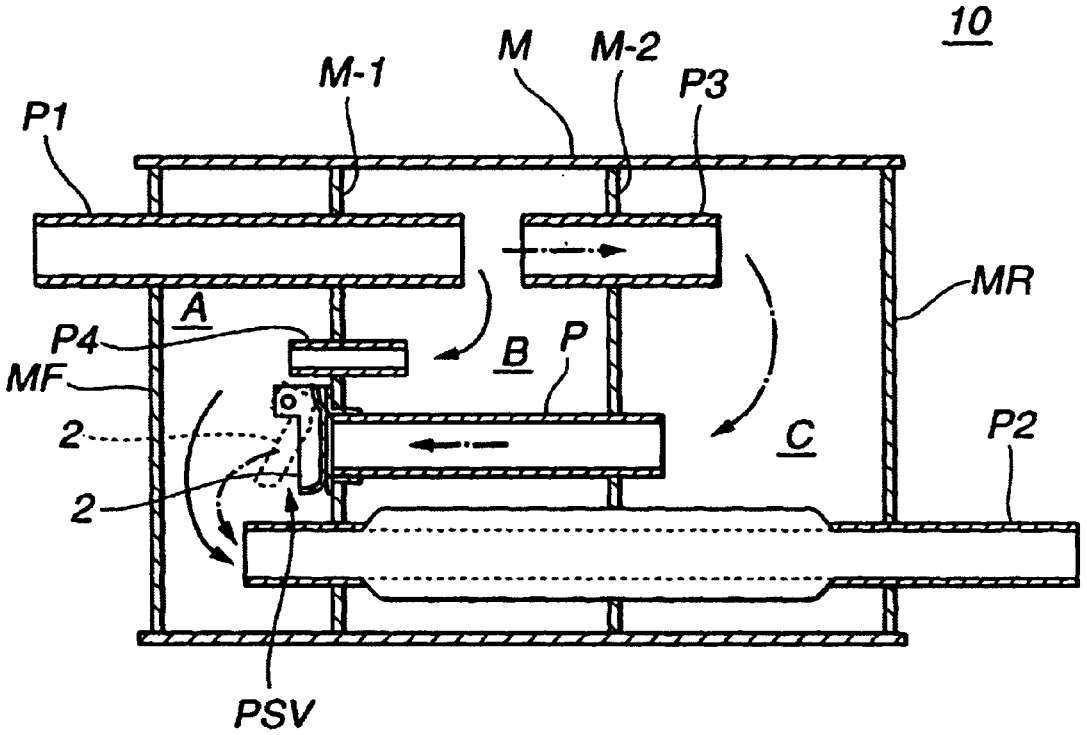
FIG. 12 is a sectional view of a controllable exhaust muffler to which the pressure sensible valve of the present invention is practically applied.

In FIG. 12, there is shown a controllable exhaust muffler 10 to which a pressure sensible valve PSV of the present invention is practically applied.

The exhaust muffler 10 comprises a casing M whose axially opposed ends are closed by front and rear walls MF and MR. Two partition walls M-1 and M-2 are arranged in the casing M to partition the interior of the casing M into first, second and third chambers A, B and C, as shown. An inlet pipe P1 extends from the outside of the casing M to the second chamber B while passing through the first chamber A. An outlet pipe P2 extends from the first chamber A to the outside of the casing M while passing through the second and third chambers B and C. A larger inner pipe P3 is held by the partition wall M-2 to connect the second and third chambers B and C, and a smaller inner pipe P4 is held by the partition wall M-1 to connect the second and first chambers B and A.

The partition walls M-1 and M-2 are respectively formed with openings for mounting a passing pipe P which extends across the second chamber B to connect the first and third chambers A and C. The passing pipe P is welded to the partition walls M-1 and M-2 at the openings. For ease of explanation, the left open end of the passing pipe P exposed to the first chamber A will be referred to as a first open end and the right open end of the passing pipe P exposed to the third chamber C will be referred to as a second open pipe.

The pressure sensible valve PSV of the present invention is arranged in the first chamber A to selectively close and open the first open end of the passing pipe P. As will be described in detail hereinafter, the pressure sensible valve PSV has a pivotal valve plate structure 2 which is biased in a direction to close the first open end of the passing pipe, P. That is, under a normal condition, the valve plate structure 2 closes the first open end of the passing pipe P. In this case, the exhaust gas from the engine flows in a direction as indicated by solid line arrows. While, when, due to increase of the exhaust gas from the engine, the pressure in the third chamber C exceeds a certain degree, the valve plate 2 is forced to open the passing pipe P against the biasing force. In this case, the exhaust gas is permitted to flow in directions as indicated by solid line arrows and phantom line arrows. That is, direct connection between the first and third chambers A and C is established, and thus the performance of the exhaust muffler 10 changes.

Figure 1:
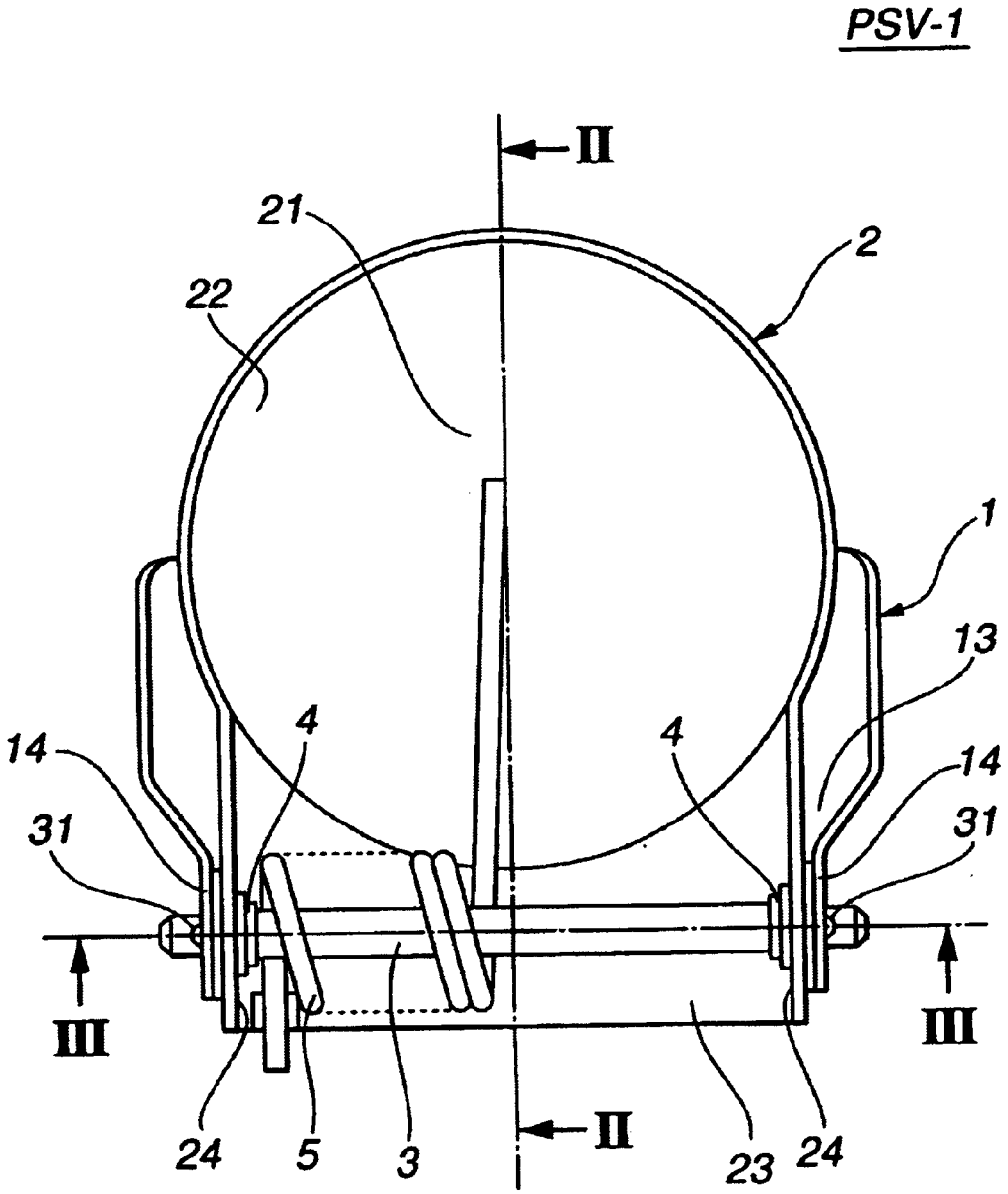
FIG. 1 is a plan view of a pressure sensible valve, which is a first embodiment of the present invention.
Figure 2:
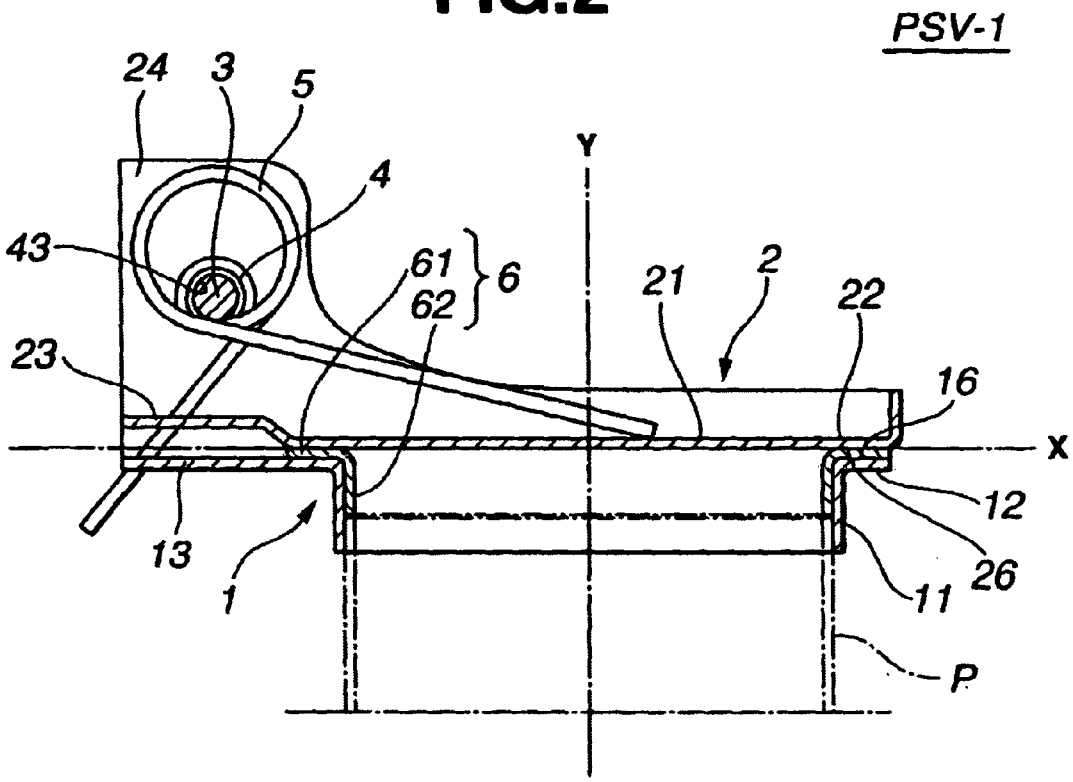
FIG. 2 is a sectional view taken along the line II—II of FIG. 1.
Figure 3:
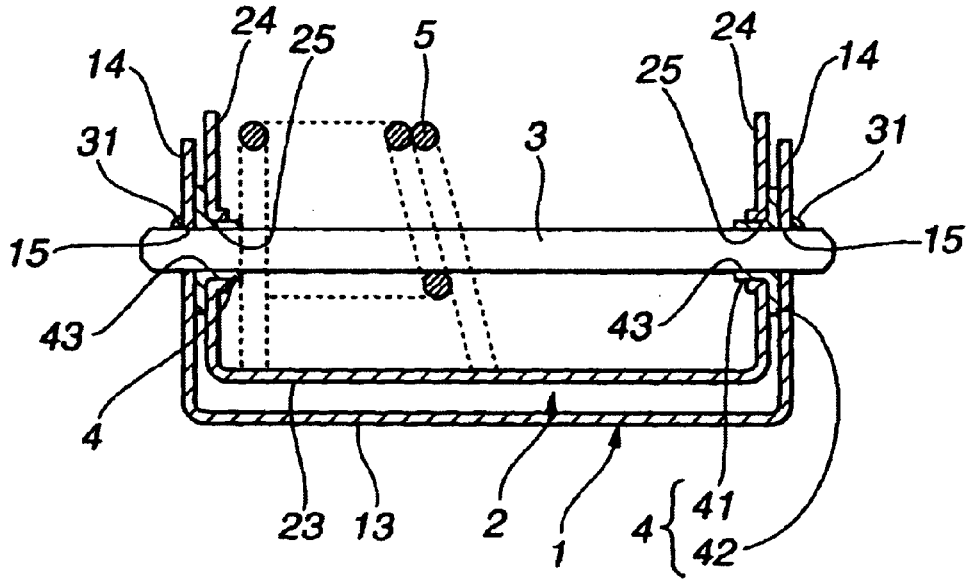
FIG. 3 is a sectional view taken along the line III—III of FIG. 1.
Figure 4:
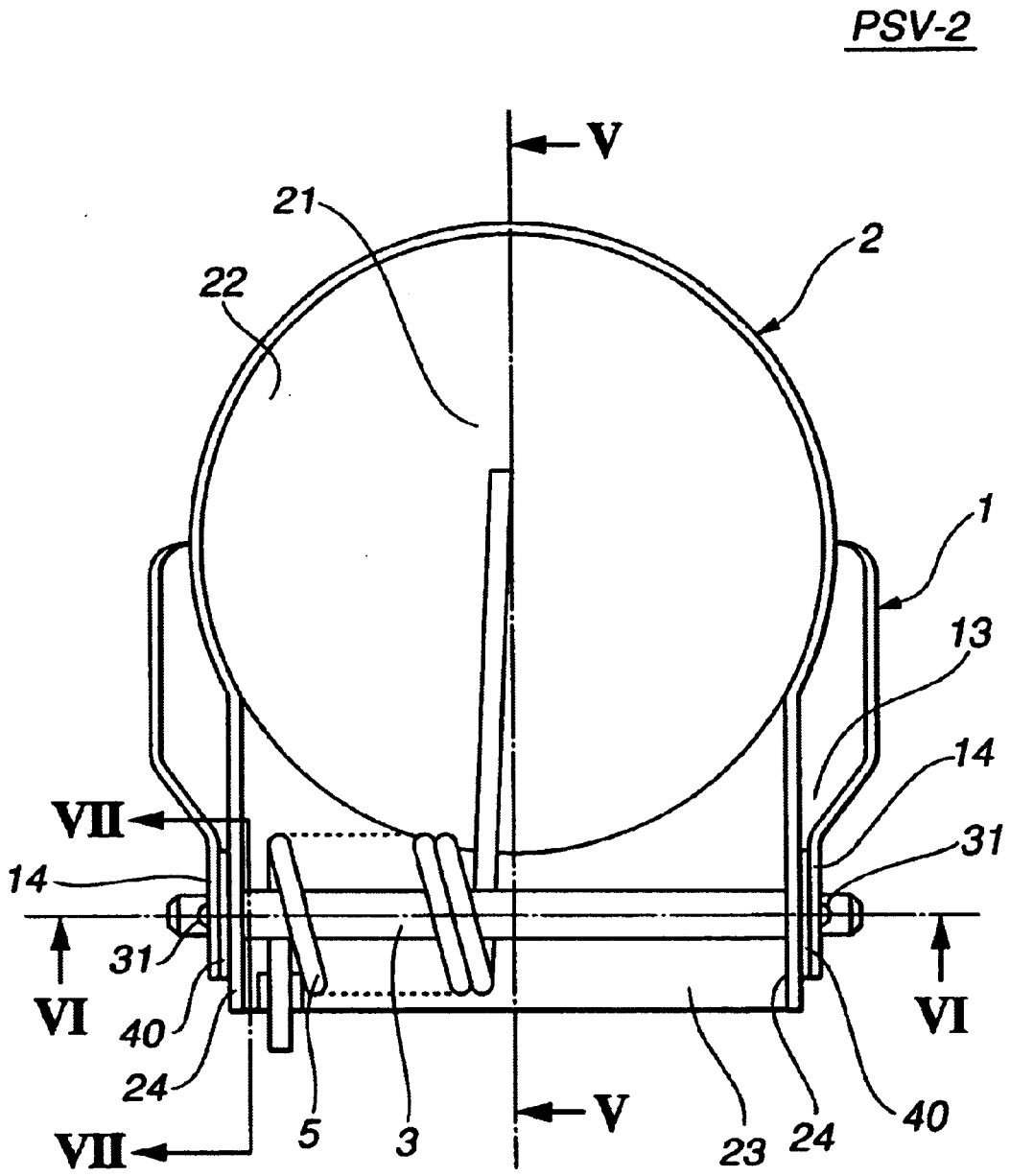
FIG. 4 is a plan view of a pressure sensible valve, which is a second embodiment of the present invention.

Referring to FIGS. 1 to 3 of the drawings, there is shown a pressure sensible valve PSV-1 which is a first embodiment of the present invention.

As is seen from FIG. 2 which is a sectional view taken along the line II—II of FIG. 1, the valve PSV-1 is mounted on the first open end of the passing pipe P. Thus, as will be seen from FIG. 12, the valve PSV-1 is exposed to the first chamber A of the exhaust muffler 10 upon assembly.

As is seen from FIG. 2, the valve PSV-1 comprises a valve seat structure 1 which includes a collar portion 11 tightly disposed on the first open end of the passing pipe P, an annular flat seat portion 12 extending radially outward from an upper end of the collar portion 11, a flat base portion 13 extending radially outward from a left part of the seat portion 12 and first pair of side wall portions 14 (see FIG. 3) which extend upward from opposed sides of the flat base portion 13. As is seen from FIG. 3, the first side wall portions 14 are respectively formed with circular shaft openings 15 which are aligned. As is seen from FIG. 2, the annular flat seat portion 12 has a flat annular upper surface 16 which serves as a seat for a next-mentioned valve plate structure 2.

As is seen from FIG. 2, the valve plate structure 2 is pivotally held by the side wall portions 14 to selectively close and open the first end of the passing pipe P. When closing the first open end of the passing pipe P, the valve plate structure 2 can be neatly seated on the flat annular surface 16, as shown. That is, the valve plate structure 2 comprises a circular valve plate portion 21 (see FIG. 1), an annular flat sealing portion 22 forming a peripheral part of the circular valve plate portion 21, a flat base portion 23 extending radially outward from a left part (as viewed in FIG. 2) of annular flat sealing portion 22 and a second pair of side wall portions 24 (see FIG. 3) which extend upward from opposed sides of the flat base portion 23. As is seen from FIG. 3, the second side wall portions 24 are respectively formed with circular shaft openings 25 which are aligned. As is seen from FIG. 2, the annular flat sealing portion 22 has a flat annular lower surface 26 which can be neatly seated on the flat annular upper surface 16 of the above-mentioned valve seat structure 1.

As is seen from FIG. 3, the second side wall portions 24 of the valve plate structure 2 are arranged between the first side wall portions 14 of the valve seat structure 1, having the shaft openings 25 and 15 of the second and first side wall portions 25 and 14 kept aligned. A pivot shaft 3 of circular cross section passes through the aligned shaft openings 25 and 15, so that the valve plate structure 2 can pivot about the pivot shaft 3 relative to the valve seat structure 1. The pivot shaft 3 is welded at portions 31 thereof to outer surfaces of the first side wall portions 14 of the valve seat structure 1.

As is seen from FIG. 3, within the shaft openings 25 of the second side wall portions 24 of the valve plate structure 2, there are installed respective bushes 4, The bushes 4 are constructed of a pressed stainless wire mesh or the like. Each bush 4 comprises a tubular part 41 which is disposed between the shaft opening 25 and the shaft 3 and an annular flange part 42 which is disposed between the first and second side wall portions 14 and 24.

As is seen from FIG. 1, a coil spring 5 is disposed about a left half of the pivot shaft 3, having one end pressed against the circular valve plate portion 21 of the valve plate structure 2 and the other end hooked to the flat base portion 13 of the valve seat structure 1. With this, the valve plate structure 2 is biased toward the valve seat structure 1, that is, in a direction to close the passing pipe P having the annular flat sealing portion 22 of the circular valve plate portion 21 of the valve plate structure 2 pressed against the annular flat seat portion 12 of the valve seat structure 1.

As is seen from FIG. 2, an annular seal member 6 is disposed on the annular flat seat portion 12 of the valve seat structure 1. The seal member 6 is constructed of a pressed stainless wire mesh, and comprises an annular flat part 61 which is disposed on the flat annular upper surface 16 of the annular flat seat portion 12 and a tubular part 62 which is snugly received in the collar portion 11. The tubular part 62 is welded to the inner surface of the collar portion 11 to tightly fix the annular seal member 6 to the valve seat structure 1.

In the following, operation of the pressure sensible valve PSV-1 will be described with the aid of FIG. 12 which shows the controllable exhaust muffler 10.

Under operation of an associated engine, exhaust gas is led into the exhaust muffler M from the inlet pipe P1. When the engine speed is relatively low, the pressure of the exhaust gas from the engine is low, and thus, the valve plate structure 2 assumes its close position as is shown by a solid line in the drawing. Under this condition, the exhaust gas is forced to flow in a direction as shown by the solid line arrows, allowing the third chamber C to act as a resonant chamber.

While, when the engine speed is relatively high, the pressure of the exhaust gas becomes high, and, when the pressure exceeds a certain value, the pressure in the third chamber C forces the valve plate structure 2 to open against the biasing force of the coil spring 5. Thus, under this condition, the exhaust gas is permitted to flow in the directions as shown by the solid line arrows and phantom line arrows. That is, the first and third chambers A and C are directly connected, and thus, the it performance of the exhaust muffler 10 changes. In other words, due to opening of the passing pipe P, the back pressure in the muffler is reduced.

As is understood from FIG. 2, under the close condition of the pressure sensible valve PSV-1, the flat annular lower surface 26 of the valve plate structure 2 makes a so-called "surface-to-surface contact" to the annular flat part 61 of the seal member 6 mounted on the valve seat structure 1, and the surface-to-surface contact is assured by the biasing force of the coil spring 5. More specifically, the surface-to-surface contact is carried out on a common imaginary flat surface X. Thus, even if the relative positioning between the valve seat structure 1 and the valve plate structure 2 is somewhat poor in a direction parallel to the imaginary surface X, that is, in a direction perpendicular to an axis Y of the collar portion 11 of the valve seat structure 1, a reliable sealing is still obtained between the structures 1 and 2.

Figure 13:
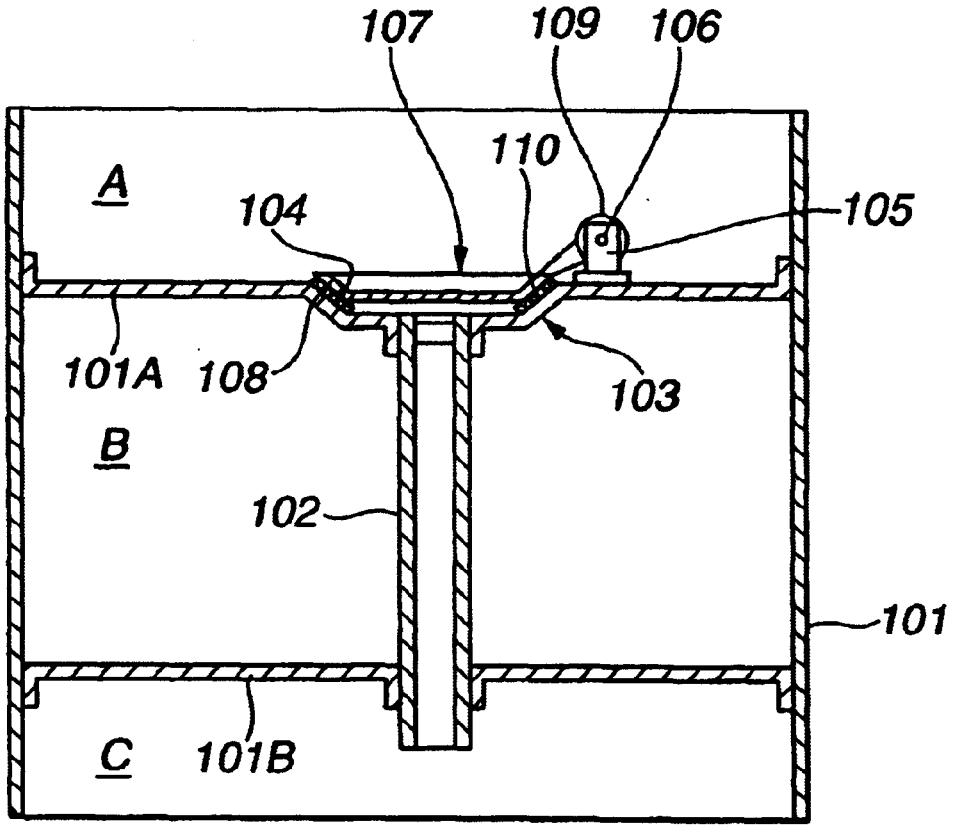
FIG.13 ( PRIOR ART )
FIG. 13 is a sectional view of an exhaust muffler at a position where a known pressure sensible valve is installed.

This advantage will be well understood from the following description directed to the known pressure sensible valve mounted in the exhaust muffler of FIG. 13.

As is seen from this drawing, in the known valve, the surface-to-surface contact between the tapered periphery 108 of the valve plate 107 and the sealing member 110 of the valve seat 103 is not achieved on a common flat surface, but on numerous imaginary surfaces. Thus, if the valve plate 107 is displaced even slightly in a lateral direction in the drawing, the tapered periphery 108 and the sealing member 110 instantly produces a clearance therebetween at one side, inducing undesirable exhaust gas leakage therethrough.

Besides the above advantage, the pressure sensible valve PSV-1 of the first embodiment has the following advantages.

As is seen from FIG. 2, the annular seal member 6 is constructed to have the annular flat part 61 and the tubular part 62. This means that the tubular part 62 can serve as a positioning means. That is, when the tubular part 62 is put into the collar portion 11 of the valve seat structure 1, the annular flat part 61 is automatically set at a right position relative to the valve seat structure 1. This facilitates the work for spot-welding the seal member 6 to the collar portion 11 of the valve seat structure 1. Because the welding between the seal member 6 and the collar portion 11 is made at the tubular part 62 of the seal member 6, the annular flat part 61 of the seal member 6 is not affected, that is, the flatness of the part 61 is kept unchanged.

Referring to FIGS. 4 to 7, there is shown a pressure sensible valve PSV-2 which is a second embodiment of the present invention. The valve PSV-2 of the second embodiment is similar to the above-mentioned valve PSV-1 of the first embodiment, and thus only parts or portions that are different from those of the first embodiment will be described in detail in the following, and substantially same parts and portions are denoted by the same numerals.

Figure 6:
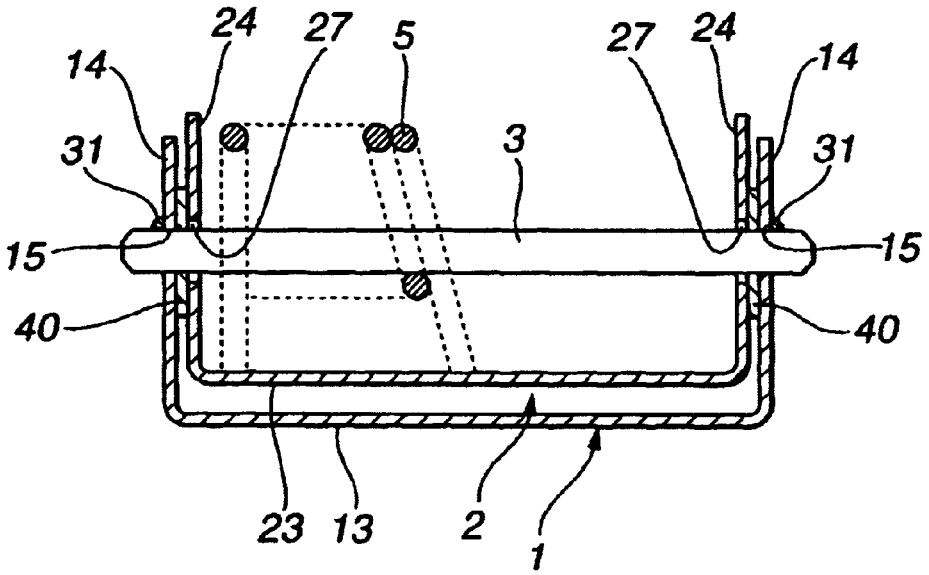
FIG. 6 is a sectional view taken along the line VI—VI of FIG. 4.

As is seen from FIG. 6, the first side wall portions 14 of the valve seat structure 1 are respectively formed with aligned shaft openings 15 like in case of the first embodiment.

Figure 5:
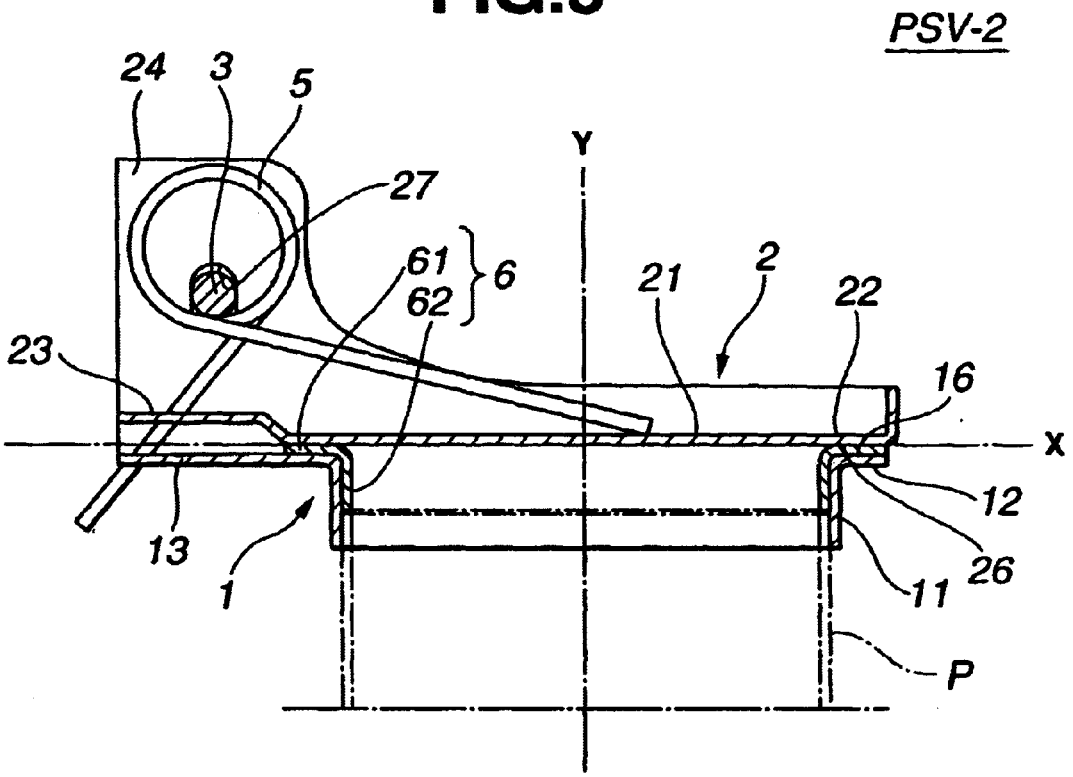
FIG. 5 is a sectional view taken along the line V—V of FIG. 4.
Figure 7:
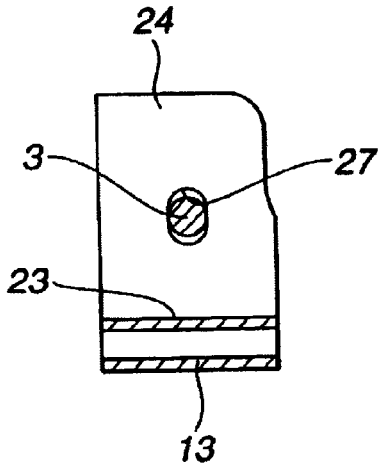
FIG. 7 is a sectional view taken along the line VII—VII of FIG. 4.
Figure 8:
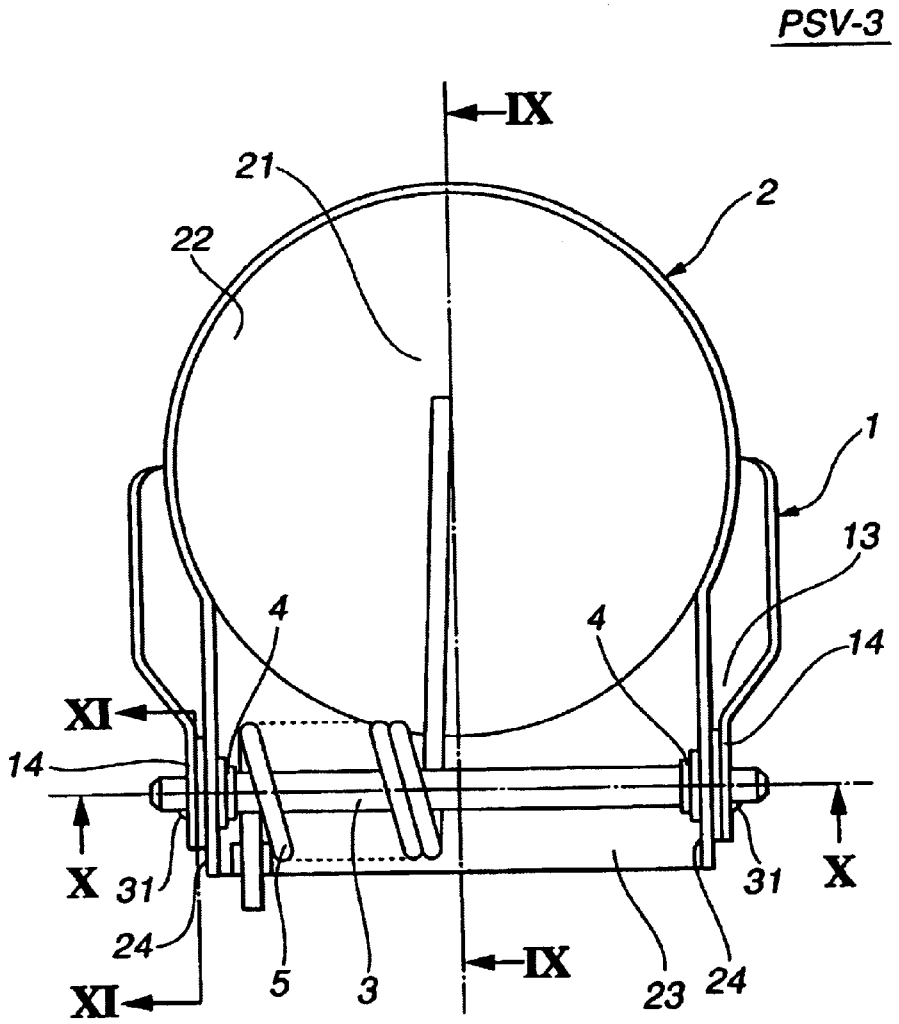
FIG. 8 is a plan view of a pressure sensible valve, which is a third embodiment of the present invention.

However, as is seen from FIGS. 5, 6 and 7, the second side wall portions 24 of the valve plate structure 2 are respectively formed with elliptic shaft openings 27 which are aligned. That is, as is seen from FIG. 5, each elliptic shaft opening 27 has a minor axis substantially equal to the diameter of the pivot shaft 3 and a major axis longer than the diameter of the pivot shaft 3. As shown, each elliptic shaft opening 27 is so oriented that the major axis extends in a direction perpendicular to the major surface of the circular valve plate portion 21 of the valve plate structure 2.

Referring back to FIG. 6, two washers 40 are disposed between the first and second side wall portions 14 and 24, respectively.

Due to the similar arrangement, substantially same advantages as those of the above-mentioned first embodiment PSV-1 are obtained also in the second embodiment PSV-2. In addition to these advantages, the following advantage is further expected in the second embodiment PSV-2.

That is, as is seen from FIG. 5, when the valve plate structure 2 assumes the close position, the annular flat sealing portion 22 of the structure 2 is much assuredly pressed against the seal member 6 on the annular flat seat portion 12, because, due to elliptic shape of the shaft openings 27, the valve plate structure 2 is permitted to have a freedom in positioning relative to the valve seat structure 1 in a direction parallel with the axis Y of the valve seat structure 1 (more specifically, the collar portion 11 of the same). Thus, the sealing performance of the valve PSV-2 is improved.

Referring to FIGS. 8 to 11, there is shown a pressure sensible valve PSV-3 which is a third embodiment of the present invention. Like in the above-mentioned second embodiment, the valve PSV-3 of this third embodiment is similar to the above-mentioned valve PSV-1 of the first embodiment, and thus only parts or portions that are different from those of the first embodiment will be described in detail in the following, and substantially same parts and portions are denoted by the same numerals.

Figure 10:
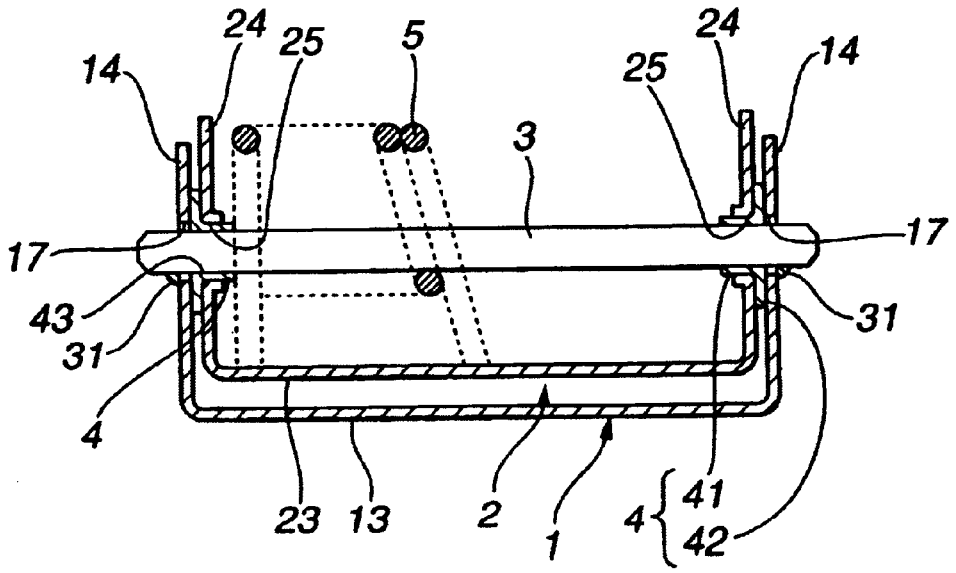
FIG. 10 is a sectional view taken along the line X—X of FIG. 8.

As is seen from FIG. 10, the second side wall portions 24 of the valve plate structure 2 are respectively formed with aligned circular shaft openings 25 like in case of the first embodiment.

The bushes 4 are incorporated with the first and second side wall portions 14 and 24 like in the first embodiment. Each bush 4 has a circular shaft opening 43 whose diameter is substantially equal to that of the pivot shaft 3.

Figure 11:
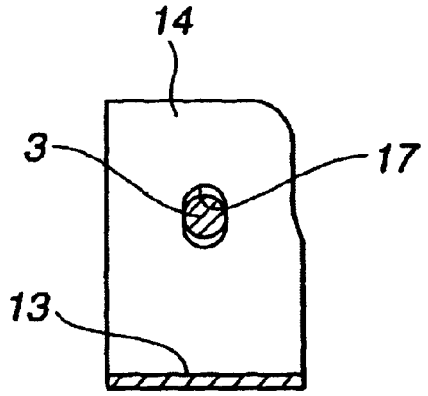
FIG. 11 is a sectional view taken along the line XI—XI of FIG. 8.

However, as is seen from FIGS. 10 and 11, the first side wall portions 14 of the valve seat structure 1 are respectively formed with elliptic shaft openings 17 which are aligned. That is, as is seen from these drawings, each elliptic shaft opening 17 has a minor axis substantially equal to the diameter of the pivot shaft 3 and a major axis longer than the diameter of the pivot shaft 3. Each elliptic shaft opening 17 is so oriented that the major axis extends in a direction perpendicular to the flat base portion 13 of the valve seat structure 1.

Due to the similar arrangement, substantially same advantages as those of the first embodiment PSV-1 are obtained also in the third embodiment PSV-3.

In the following, steps for assembling the pressure sensible valve PSV-3 of the third embodiment will be described with reference to the drawings.

Figure 9:
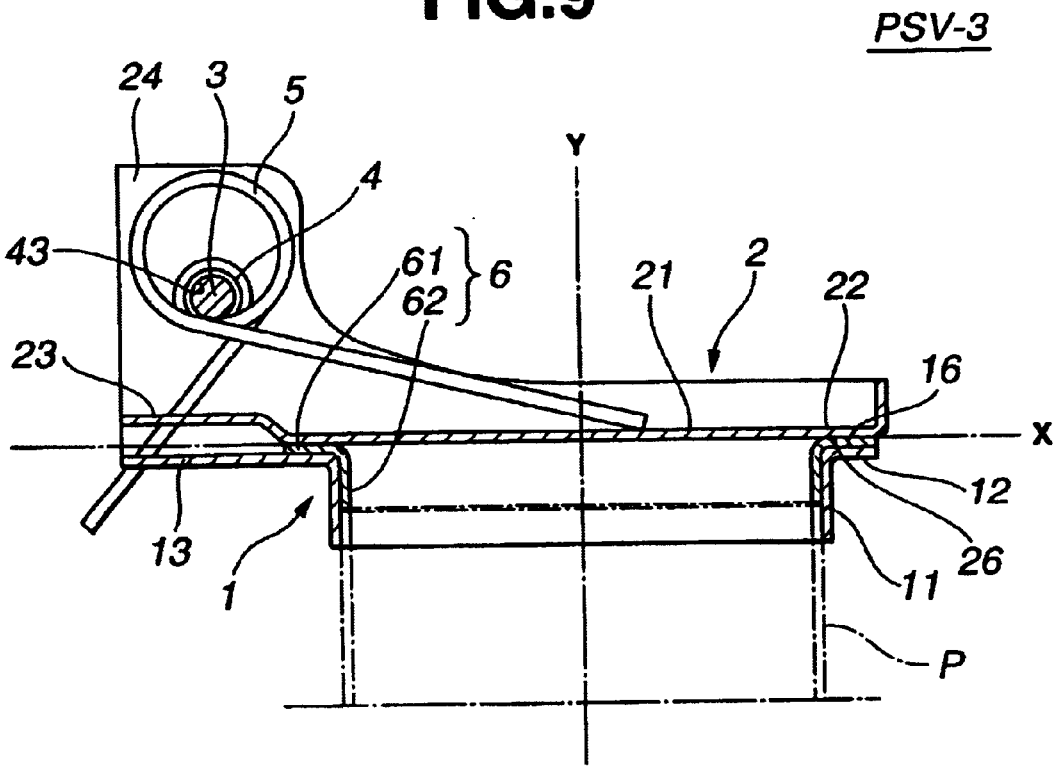
FIG. 9 is a sectional view taken along the fine IX—IX of FIG. 8.

First, as is understood from FIG. 9, the annular seal member 6 is mated with the collar portion 11 of the valve seat structure 1 and welding is applied to the tubular part 62 of the seal member 6 to tightly secure the seal member 6 to the collar portion 11. Then, the valve plate structure 2 is brought onto the annular seal member 6 contacting the flat annular lower surface 26 with the annular flat part 61. Then, the pivot shaft 3 is inserted into the elliptic shaft opening 17 of one of the first side wall portions 14, one of the bushes 4 which has been set in the opening 25 of one of the second side wall portions 24, the coil spring 5, the other bush 4 which has been set in the opening 25 of the other second side wall portion 24 and the elliptic shaft opening 17 of the other first side wall portion 14. Upon completion of this shaft insertion, due to the force of the coil spring 5, the pivot shaft 3 is biased upward in the elliptic shaft openings 17.

Then, by applying a suitable external force to the valve plate structure 2 against the biasing force of the coil spring 5, the valve plate structure 2 is brought down to a position where the flat annular lower surface 26 is intimately pressed against the annular flat part 61 of the seal member 6. Then, keeping the valve plate structure 2 in the position, both ends of the pivot shaft 3 are welded at 31 to the first side wall portions 14 of the valve seat structure 1. With this, the pivot shaft 3 is secured to the first side wall portions 14 keeping the valve plate structure 2 pressed against the valve seat structure 1 due to the force of the coil spring 5. That is, upon completion of the assembly, the valve PSV-3 assumes a full close position wherein the peripheral area (viz., the annular flat sealing portion 22) of the circular valve plate portion 21 of the valve plate structure 2 is intimately pressed against the flat annular upper surface 16 of the seal member 6 on the valve seat structure 1.

As is understood from the above, in the pressure sensible valve PSV-3 of the third embodiment, the elliptic shaft openings 17 of the first side wall portions 14 serve as a means for correcting the relative positioning between the valve seat structure 1 and the valve plate structure 2, and thus, upon completion of welding at the portions 31, a precise positioning is obtained therebetween thereby to obtain a high sealing performance in the full close position of the valve PSV-3.

Although the invention has been described above with reference to the embodiments of the invention, the invention is not limited to such embodiments as described above. Various modification and variations of such embodiment may be carried out by those skilled in the art, in light of the above description.

In the following, some of the modifications will be described.

In the above-mentioned three embodiments PSV-1, PSV-2 and PSV-3, both the annular seat portion 12 of the valve seat structure 1 and the annular flat sealing portion 22 of the valve plate structure 2 are constructed flat. However, if desired, one of them may be an annular projection extending therearound.

In the above-mentioned embodiments, the annular seal member 6 is welded to the valve seat structure 1. However, if desired, the annular seal member 6 may be welded to the valve plate structure 2. That is, in this modification, an annular flat seal member (6) is welded to a lower surface (see FIG. 2) of the annular flat sealing portion 22 of the structure 2.

In the above-mentioned embodiments, the tubular part 62 of the seal member 6 extends from an inner periphery of the annular flat part 61. However, if desired, such tubular part (62) may extend from an outer periphery of the annular flat part 61.

In the above-mentioned embodiments, the seal member 6 is secured to the valve seat structure 1 by means of welding. However, if desired, other connecting technique, such as, bolt-and-nut and the like may be used.

In the above-mentioned embodiments, a pressed stainless wire mesh is used as the material of the seat member 6. However, if desired, pressed brass wire mesh or the like may be used in place of the pressed stainless wire mesh.

The entire contents of Japanese Patent Application 2000-275073 (filed Sep. 11, 2000) are incorporated herein by reference.

What is claimed is:

1. A valve for use with a passing pipe installed in an exhaust muffler, comprising:

a valve seat structure adapted to be secured to an outlet end of said passing pipe, said valve seat structure including a flat seat surface portion which extends around the outlet end of said passing pipe;

a valve plate structure pivotally connected to said valve seat structure, said valve plate structure including a valve plate portion and a flat sealing portion which forms a peripheral part of said valve plate portion, said valve plate structure having a closed position wherein said valve plate portion closes the outlet end of said passing pipe having said flat sealing portion entirely pressed against the flat seat surface of said valve seat structure and an open position wherein said valve plate portion opens the outlet end of said passing pipe having the flat sealing portion separated from said flat seat surface;

a biasing structure which biases said valve plate structure to assume said closed position; and a seal member which is fixed to one of said flat seat surface and said flat sealing portion, so that when said valve plate structure assumes the closed position, the seal member is compressed between said flat seat surface and said flat sealing portion thereby assuring sealing therebetween, wherein the entire pressing of said flat sealing portion against said flat seat surface is carried out on a common imaginary flat surface, and wherein said seal member comprises:

an annular flat part which is disposed on said flat seat surface; and a tubular portion which is disposed in a collar portion of said valve seat structure, said collar portion being disposed about the outlet end of said passing pipe.

2. A valve as claimed in claim 1, in which said tubular portion is welded to said collar portion.

3. A valve for use with a passing pipe installed in an exhaust muffler, comprising:

a valve seat structure adapted to be secured to an outlet end of said passing pipe, said valve seat structure including a flat seat surface portion which extends around the outlet end of said passing pipe;

a valve plate structure pivotally connected to said valve seat structure, said valve plate structure including a valve plate portion and a flat sealing portion which forms a peripheral part of said valve plate portion, said valve plate structure having a closed position wherein said valve plate portion closes the outlet end of said passing pipe having said flat sealing portion entirely pressed against the flat seat surface of said valve seat structure and an open position wherein said valve plate portion opens the outlet end of said passing pipe having the flat sealing portion separated from said flat seat surface;

a biasing structure which biases said valve plate structure to assume said closed position; and a pivot structure which includes:

a first pair of side wall portions defined by said valve seat structure, said first side wall portions being formed with first aligned openings respectively;

a second pair of side wall portions defined by said valve plate structure, said second side wall portions being formed with second aligned openings respectively, said second side wall portions being put between said first side wall portions in such a manner that the first and second aligned openings are all aligned; and a pivot shaft passing through said aligned first and second openings of the first and second side wall portions, wherein the entire pressing of said flat sealing portion against said flat seat surface is carried out on a common imaginary flat surface.

4. A valve as claimed in claim 3, in which each of said first and second aligned openings is a circular opening having a diameter substantially equal to that of said pivot shaft and in which said pivot shaft is fixed to said first side wall portions assuring positioning of said pivot shaft relative to said first side wall portions.

5. A valve as claimed in claim 3, in which each of said first aligned openings is a circular opening having a diameter substantially equal to that of said pivot shaft, in which each of said second aligned openings is an elliptic opening having a minor axis substantially equal to the diameter of said pivot shaft and a major axis longer than the diameter of said pivot shaft, and in which said pivot shaft is fixed to said first side wall portions assuring positioning of said pivot shaft relative to said first side wall portions.

6. A valve as claimed in claim 3, in which each of said first aligned openings is an elliptic opening having a minor axis substantially equal to a diameter of said pivot shaft and a major axis longer than the diameter of said pivot shaft, in which each of said second aligned openings is a circular opening having a diameter substantially equal to the diameter of said pivot shaft, and in which said pivot shaft is fixed to said first side wall portions assuring positioning the pivot shaft relative to said first side wall portions.

7. A method of assembling a valve, comprising the steps of:

(a) preparing a valve seat structure and a valve plate structure, said valve seat structure including a first pair of side wall portions which are formed with first aligned openings which are elliptic in shape, said valve plate structure including a second pair of side wall portions which are formed with second aligned openings which are circular in shape;

(b) putting said second side wall portions between said first side wall portions and keeping the first and second side wall portions in such a manner that the first and second aligned openings are all aligned;

(c) inserting a pivot shaft into the aligned first and second openings so that upon insertion of the pivot shaft, the valve plate structure becomes pivotal relative to said valve seat structure about the pivot shaft;

(d) positioning said valve plate structure relative to said valve seat structure by moving the pivot shaft in the first aligned openings; and (e) fixing said pivot shaft to said first side wall portions while keeping the positioning between the valve plate structure and said valve seat structure.

8. A method as claimed in claim 7, further comprising between the steps (b) and (c), (f) inputting a coil spring between the second side wall portions so that upon completion of the step (c), the valve plate structure is biased to assume a closed position relative to said valve seat structure due to a biasing force of said coil spring.

9. A method as claimed in claim 7, in which when the step (d) is accomplished, an annular flat sealing portion defined by said valve seat structure is intimately pressed against an annular flat seat surface defined by said valve plate structure.

* * * * *